United States Patent [19]

Bollè et al.

[11] Patent Number: 4,899,873

[45] Date of Patent: Feb. 13, 1990

[54] CASE FOR SUNGLASSES

[76] Inventors: Maurice Bollè, Rue Tacon, Boite Postle 139, 01104 Oyonnax, Cedex, France; Dean Bassett, 9033 W. Wisconsin Ave., Lakewood, Colo. 80226

[21] Appl. No.: 161,853

[22] Filed: Feb. 29, 1988

[51] Int. Cl.[4] ..... A45G 11/04

[52] U.S. Cl. ..... 206/5; 206/38

[58] Field of Search ..... 206/5, 6, 38

[56] References Cited

U.S. PATENT DOCUMENTS

| | | | |
|---|---|---|---|
| 2,529,000 | 11/1950 | Cameron | 206/38 R |
| 3,000,417 | 9/1961 | Goldstein | 206/5 R |
| 3,144,127 | 8/1964 | Fogel | 206/5 R |
| 3,323,638 | 6/1967 | Dishart | 206/5 X |
| 4,257,463 | 3/1981 | Monaco | 206/5 X |
| 4,287,985 | 9/1981 | Feniger | 206/5 |

*Primary Examiner*—William Price

*Attorney, Agent, or Firm*—Rosen, Dainow & Jacobs

[57] ABSTRACT

A protective carry case for eyeglasses having removable and replaceable components is provided. Storage space is provided in the case for eyeglasses frame, replacement pane, extra foam absorber strip, and interchangeable/adjustable temple members.

10 Claims, 2 Drawing Sheets

CASE FOR SUNGLASSES

BACKGROUND OF THE INVENTION

This invention relates to a protective carry case for protective eyewear, such as sunglasses and the like, and has for one of its objects the provision of such a case which will provide structural and environmental protection for the sunglasses during periods of non-use and yet permit the ready withdrawal of the eyeglasses from the case when desired.

A further object of the invention is the provision of a lightweight, compact, protective package for the convenient retention of a pair of eyeglasses having removable and replaceable components which are easy to assemble and adjust for optimum fit and comfort and so as to permit wear under variable light and weather conditions. Specifically, storage space is provided in the case for eyeglasses frame, replacement pane, extra foam absorber strips, and interchangeable/adjustable straight and cable temples.

Another object of the invention is the provision of a package which permits easy accessibility to extra components of eyeglasses having replaceable and interchangeable parts, so as to permit selection by the wearer of panes, temples and foam absorber strips, in various colors, sizes and shapes.

A final object of this invention is the provision of a protective carry case for eyeglasses which includes fastening means for convenient attachment of the case to objects such as bicycles.

SUMMARY OF THE INVENTION

With these and other objects in view, it will be seen that the protective carry case of this invention provides a convenient receptacle for the storage of a pair of protective eyewear, such as sunglasses and the like, and its removable and replaceable component parts, and protects same from external influences. The case is lightweight, compact and constructed in a manner which insures easy accessibility by the wearer to the eyeglasses and its components.

Eyeglasses of the type which the case of this invention is meant to contain have replaceable and interchangeable component parts as described in co-pending application, Ser. No. 161,852 filed on even date. Specifically, eyeglasses such as sunglasses have replaceable and interchangeable panes, which are available in a variety of colors and intensities to suit light and weather conditions; interchangeable/ adjustable temple members in straight and cable styles to fit a variety of head contours; and foam absorber strips which absorb moisture from the wearer's brow, preventing moisture from penetrating the interior of the eyeglasses and interfering with the wearer's vision. It is preferred that a supply of these component parts be available in different sizes, shapes and colors for assembly by the wearer.

Specifically, the protective carry case of this invention comprises a flexible, open-topped, pouch-shaped container body for receiving and protectively enclosing eyeglasses, said container body having a curved front wall and a substantially straight rear wall, the front wall joined about its bottom and side peripheral portions to the bottom and side peripheral portions of the rear wall. A contoured flexible partition having a length and width less than that of the front wall is interposed between the front and rear walls of the container body and angled towards the front wall; a lower central peripheral portion of the partition is fixedly attached to the bottom peripheral portions of the front and rear walls of the container body. The partition and the front wall of the container body define a recess for receiving and protectively enclosing a replacement pane for the sunglasses. The rear wall and the partition form an opening into which a pair of eyeglasses is inserted into the case for storage therein. A pocket joined at its bottom and side peripheral portions to the external rear wall of the container body is provided for receiving and protectively enclosing replacement temple members and foam absorber strips. Means for releaseably securing said pocket to the external rear wall of the container body is provided. The top peripheral portion of the rear wall comprises a rounded flexible top-flap bendable downwardly for covering the opening between the front and rear walls of the container body. A flexible strap projects from and is contiguous with the upper central peripheral portion of the front wall. The strap has a length sufficient to wrap around the top flap, pocket, rear wall and a portion of the front wall of the container body and is releaseably attachable to the front wall of the container body for securing the case.

With these and other features and advantages in view, the invention will be more fully understood with reference to the following description and drawings wherein:

DRAWING DESCRIPTION

DETAILED DESCRIPTION

Figure 1:
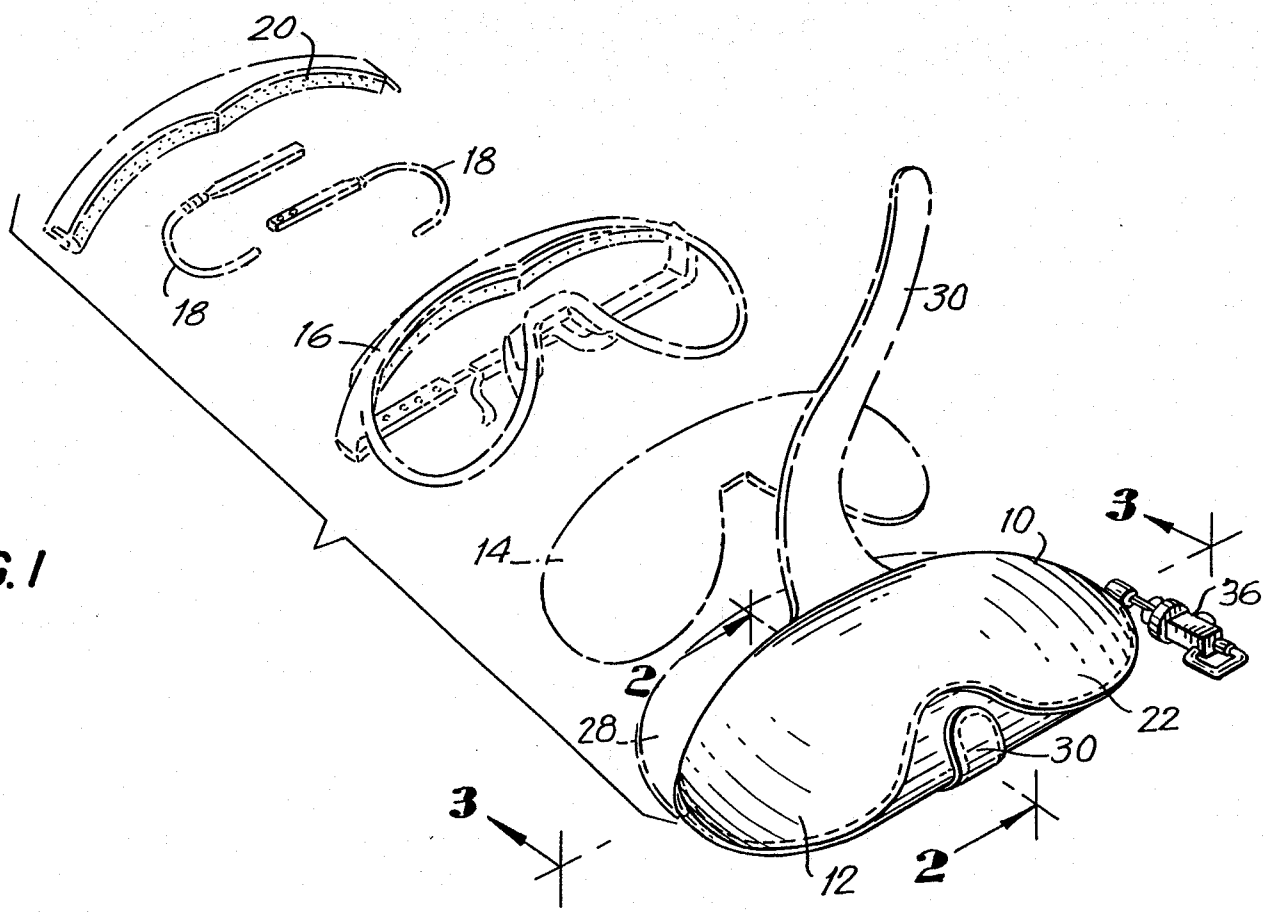
FIG. 1 is a left front view of the protective carry case for eyeglasses of this invention; contents of the case are shown in phantom lines.
Figure 3:
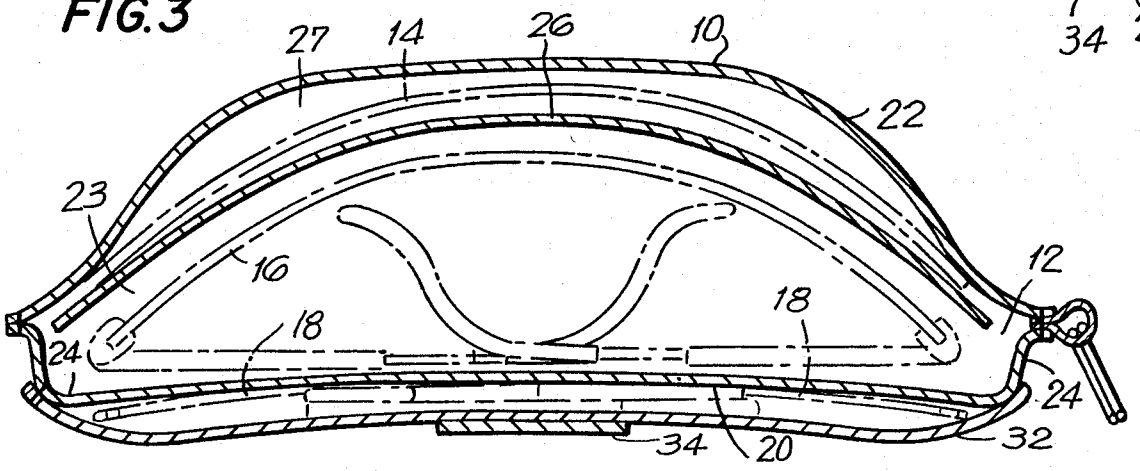
FIG. 3 is a cross-sectional view taken along lines 3—3 of FIG. 1.

FIGS. 1 and 3 illustrate the general concept of a case for eyeglasses in accordance with the invention. The case, indicated generally at 10, comprises a flexible plastic pouch-shaped container body 12, having a substantially triangular configuration. Stored within the case, as indicated in phantom lines in FIG. 1, in the order of storage, are: a replacement pane 14; eyeglasses frames 16, shown paneless; adjustable replacement temple members 18 and replacement foam absorber strip 20. The wearer may assemble the eyeglasses, such as sunglasses, from the components stored in the case so as to select pane color and intensity, temple member shape and size and replacement foam absorber strip for maximum fit and comfort.

The case 10 comprises a curved front wall 22 and substantially straight rear wall 24, shown in FIG. 3. The front wall 22 is joined about its bottom and side peripheral portions to the bottom and side peripheral portions of the rear wall 24.

A contoured flexible partition 26, indicated in FIG. 3, located between the front 22 and rear walls 24 of the case and angled towards the front wall 22 of the case. The partition 26 and the front wall 22 of the case define a recess 27 for receiving and protectively enclosing a replacement pane 14 for the sunglasses. The partition 26 has a length and width less than that of the front wall 22. The lower central peripheral portion of the flexible partition 26 is substantially attached to the lower peripheral portions of the front 22 and rear walls 24 of the case 10. Preferably, the flexible partition 26 has a nose-shaped area of merger with the front wall 22 of the case 10 such that lateral movement of the replacement pane 14 is restricted and the pane 14 is properly centered in the recess 27.

As indicated in phantom lines in FIG. 1, the top peripheral portion of the rear wall 24 is a rounded flexible top-flap 28, which may be folded down to cover the opening 23 between the front 22 and rear walls 24 of the case. Projecting from and contiguous with the upper central peripheral portion of the front wall 22 is an elongated flexible strap 30. As will be explained, the strap 30 wraps around the case 10 and is secured to the lower front wall 22 of the case 10, as indicated in FIG. 1.

Figure 2:
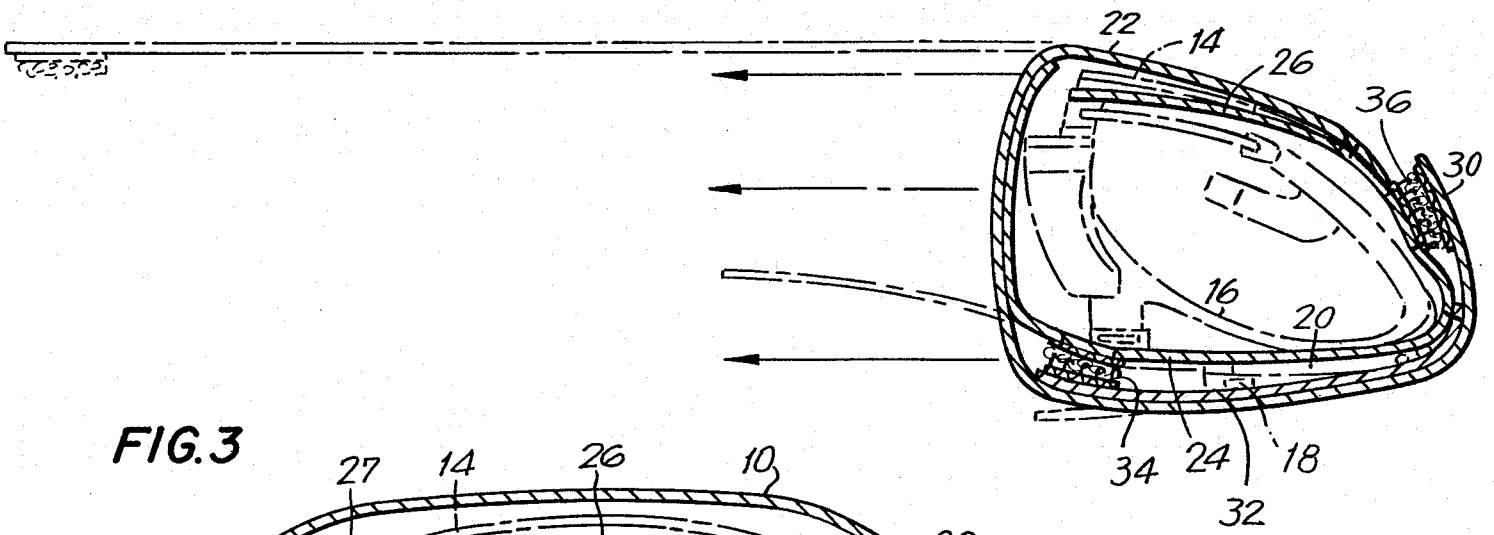
FIG. 2 is a cross-sectional view taken along lines 2—2 of FIG. 1.

A pocket 32, indicated in FIG. 3, is provided to hold replacement temple members 18 and foam absorber strips 20. The pocket 32 is joined at its side and bottom peripheral portions to the external rear wall 24 of the case 10. The pocket 32 is releaseably secured to the external rear wall 24 of the case 10 by closing means 34 such as velcro, as indicated in FIG. 2. Alternative closing means such as snaps, hooks, zippers etc. may be used.

The case 10 is simple to use. The case 10 is opened when the strap 30 and the top flap 28 are in their extended positions, substantially aligned with the front 22 and rear walls 24 of the case, respectively. The assembled eyeglasses or the unassembled eyeglasses frame 16 may then be inserted and stored in the case 10 in the opening between the rear wall 22 and the partition 26. A replacement pane 14 may be inserted and stored in the recess between the front wall 22 and the partition 26. The case 10 is closed by bending the top flap 28 down to cover the opening between the front 22 and rear walls 24 of the case. The case 10 is releaseably secured by wrapping the strap 30, which is of sufficient length to surround the top flap 28, pocket 32, rear wall 24 and a portion of the front wall 22 of the case, around the case and securing it by closing means 36, such as velcro, to the lower portion of the front wall 22 of the case 10. FIG. 2 is a cross sectional view through the case 10 indicating the relative positions of the eyeglasses and its components when the case is closed. Advantageously, the protective carry case of this invention includes fastening means, such as a clip, indicated by numeral 36 in FIG. 1, for attaching the case to various objects, including bicycles.

It will be understood that other protective carry cases may be made without departing from the spirit of this invention or the scope of the appended claims.

I claim:

1. A protective carry case for eyeglasses comprising:

a container body for receiving and protectively enclosing eyeglasses, said container body having a curved front wall and a substantially straight rear wall, the front wall joined about its bottom and side peripheral portions to the bottom and side peripheral portions of the rear wall;

a contoured flexible partition having a length and width less than that of the front wall interposed between the front and rear walls of the container body and angled towards the front wall, a lower central peripheral portion of the partition fixedly attached to the bottom peripheral portions of the front and rear walls of the container body, the partition and the front wall of the container body defining a recess for receiving and protectively enclosed a replacement pane for said eyeglasses, the rear wall and the partition forming an opening into which a pair of eyeglasses is inserted into the case for storage therein;

a pocket for receiving replacement members for said eyeglasses and means for releaseably securing said pocket to said external rear wall of the container body;

2. The protective carry case of claim 1 wherein said pocket is joined at its bottom and side peripheral portions to the external rear wall of the container body, for receiving and protectively enclosing replacement temple members and foam absorber strips for said eyeglasses.

3. The protective carry case of claim 2 wherein the top peripheral portion of the rear wall comprises a rounded flexible top-flap bendable downwardly for covering said opening between the front and rear walls of the container body.

4. The protective carry case of claim 3 wherein a flexible strap projects from and is contiguous with the upper central peripheral portion of the front wall, said strap having a length sufficient to wrap around said top flap, pocket, rear wall and a portion of the front wall of the container body, said strap being releaseably attachable to the front wall of the container body for securing said case.

5. The protective carry case of claim 1 wherein said partition has a central upwardly rounded lower portion fixedly attached to a central upwardly rounded lower portion of the front wall of the container body so as to restrict lateral movement and properly center the extra pane in said recess.

6. The protective carry case of claim 1 wherein said eyeglasses comprise sunglasses.

7. A protective carry case for eyeglasses of the type comprising a frame having removable and replaceable component parts, said component parts comprising removable and replaceable eyeglass panes, temple members and foam absorber strips, comprising:

a flexible, open-topped, pouch-shaped container body for receiving and protectively enclosing eyeglasses, said container body having a curved front wall and a substantially straight rear wall, the front wall joined about its bottom and side peripheral portions to the bottom and side peripheral portions of the rear wall;

a contoured flexible partition having a length and width less than that of the front wall interposed between the front and rear walls of the container body and angled towards the front wall, a lower central peripheral portion of the partition fixedly attached to the bottom peripheral portions of the front and rear walls of the container body, the partition and the front wall of the container body defining a recess for receiving and protectively enclosed a replacement pane for said eyeglasses, the rear wall and the partition forming an opening into which a pair of eyeglasses is inserted into the case for storage therein;

a pocket joined at its bottom and side peripheral portions to the external rear wall of the container body, for receiving and protectively enclosing replacement temple members and foam absorber strips for said eyeglasses, and means for releaseably securing said pocket to said external rear wall of the container body being provided;

the top peripheral portion of the rear wall comprising a rounded flexible top-flap bendable downwardly for covering said opening between the front and rear walls of the container body;

a flexible strap projecting from and contiguous with the upper central peripheral portion of the front wall, said strap having a length sufficient to wrap around said top flap, pocket, rear wall and a portion of the front wall of the container body, said strap being releaseably attachable to the front wall of the container body for securing said case.

8. The protective carry case of claim 1 wherein said partition has a central upwardly rounded lower portion fixedly attached to a central upwardly rounded lower portion of the front wall of the container body so as to restrict lateral movement and properly center the extra pane in said recess.

9. The protective carry case of claim 1 further comprising fastening means for attaching the case to objects.

10. The protective carry case of claim 1 wherein said eyeglasses comprise sunglasses.

* * * * *